US007452261B2

(12) United States Patent
Gretler et al.

(10) Patent No.: US 7,452,261 B2
(45) Date of Patent: Nov. 18, 2008

(54) PROCESS FOR MONITORING THE SETTING OF THE COOLANT NOZZLE OF A GRINDING MACHINE

(75) Inventors: Markus Gretler, Hedingen (CH); Klaus Peiffer, Wallisellen (CH)

(73) Assignee: Reishauer AG, Wallisellen (CH)

( * ) Notice: Subject to any disclaimer, the term of this patent is extended or adjusted under 35 U.S.C. 154(b) by 0 days.

(21) Appl. No.: 11/710,449

(22) Filed: Feb. 26, 2007

(65) Prior Publication Data

US 2007/0202776 A1 Aug. 30, 2007

(30) Foreign Application Priority Data

Feb. 28, 2006 (DE) ..... 10 2006 009 547

(51) Int. Cl.
*B24B 51/00* (2006.01)

(52) U.S. Cl. ..... 451/5; 451/11; 451/60

(58) Field of Classification Search ..... 451/5, 451/8, 9, 10, 60, 446, 449
See application file for complete search history.

(56) References Cited

U.S. PATENT DOCUMENTS 4,076,442 A 2/1978 Cox, Jr. et al.
6,921,321 B2 * 7/2005 Morita ..... 451/60
2006/0040584 A1 * 2/2006 Ray et al. ..... 451/5

FOREIGN PATENT DOCUMENTS

DE 27 58 676 A1 9/1978
DE 291 502 A5 7/1991
EP 0 191 232 A2 8/1986

* cited by examiner

*Primary Examiner*—Dung Van Nguyen
(74) *Attorney, Agent, or Firm*—Browdy and Neimark, P.L.L.C.

(57) ABSTRACT

A process for monitoring the correct setting of the coolant nozzle (9) of a grinding machine for grinding the tooth flanks of workpieces with premachined teeth. In an automatic test cycle after setting the machine, with the grinding wheel (2) at defined positions relative to the workpiece (3), the alterations in power consumption of the grinding spindle drive when switching on the coolant supply are measured, compared with the desired value ranges specified in the machine control system, and the machining process blocked in the event of measurements being below or above the desired value ranges.

In this manner the production of scrap and the occurrence of deflagration of the coolant/lubricant-air mixture in the machine working area, and hence a machine fire, can be effectively prevented.

20 Claims, 2 Drawing Sheets

PROCESS FOR MONITORING THE SETTING OF THE COOLANT NOZZLE OF A GRINDING MACHINE

FIELD OF THE INVENTION

The present invention concerns a process for monitoring the correct setting of the coolant nozzle of a grinding machine, in particular of a machine for grinding the tooth flanks of workpieces with premachined teeth.

BACKGROUND OF THE INVENTION

The grinding of the tooth flanks of gears and gear-like workpieces with premachined hardened teeth is a machining process which, to achieve a high economic efficiency and adequate grinding quality, must be cooled with a cooling lubricant. In order to attain an optimum cooling/lubrication, a liquid jet of a suitable pressurized cooling lubricant is directed at an optimum angle onto the periphery of the grinding wheel and into the grinding gap between the grinding wheel and workpiece. This is produced by a jet-forming coolant nozzle usually arranged and adjustable on the grinding spindle headstock or work spindle headstock, the position of which said nozzle relative to the grinding wheel or workpiece must be set appropriate to the process by the machine setter prior to beginning the machining process.

A deficient setting of the coolant nozzle results in the process being inadequately cooled and, due e.g. to overheating, the workpiece having an inferior surface quality or other deficiencies, making it unusable. Moreover due to too high temperatures of the contact surface between grinding wheel and workpiece, or to flying sparks, a deflagration of the coolant liquid and air mixture can be triggered in the machine working area, which can set fire to the machine. For this reason the correct setting of the coolant nozzle by the setter or operator on changeover to a new workpiece, for example, or after a grinding wheel change is of great importance.

This situation is taken care of in practice by thorough training of the setting and operating personnel. Another known measure for ensuring a correct setting of the coolant nozzle is the blocking of the process start by the machine control system, which is only released when the setter or operator has confirmed expressly by touch-button that the position of the coolant nozzle relative to the point of grinding is set correctly. The disadvantage of this solution is that the confirmation of the setting of the coolant nozzle offers no sure guarantee that the setting has been undertaken really according to specification, and that the risk of scrap and machine fire is not entirely excluded.

A further known measure by which at least a machine fire can be prevented is the incorporation of a fire extinguishing system in the machine working area, which is activated e.g. by a deflagration. Such a system is expensive, however, and in the event of a deflagration due to an incorrect setting of the coolant nozzle, fails to prevent a long production-impairing interruption of the machining process while the quenching medium is removed from the working area of the machine. Nor does it prevent the production of scrap as long as no deflagration takes place.

SUMMARY OF THE INVENTION

An object of the present invention, therefore, is to propose a process for monitoring the correct position of the coolant nozzle of a grinding machine, in particular of a machine for grinding the tooth flanks of workpieces with premachined teeth, which avoids the disadvantages of known machines in that the production of scrap and the occurrence of a machine fire due to deficient setting of the coolant nozzle are prevented independent of the machine setter or operator.

According to the invention, this object is achieved by the entirety of the features in claim 1.

The core of the invention consists in a special test cycle automatically taking measurements on the machine to check over the setting of the coolant nozzle previously undertaken by the machine setter or operator, and to only release the machining process if the test criteria specified in the machine control system are fulfilled. The test criteria used are preferably the results of torque measurements made oh the grinding spindle drive during the test cycle. This is based on the recognized fact that for physical fluid flow reasons the power consumption of the grinding spindle drive alters measurably when a coolant stream contacts the grinding wheel tangentially, and when the cooling lubricant is drawn into the grinding gap between the grinding wheel and workpiece surfaces.

According to the invention, after setting the grinding machine the power consumption of the grinding spindle drive is measured with and without the coolant flow switched on, and by comparison of the two measurements the setting of the coolant nozzle assessed.

According to one embodiment of the invention, an alteration in the measured power consumption deriving from the two measurements is compared with a specified desired value range, and an intervention in the setting process of the grinding machine undertaken if the measured result lies outside the desired range.

Another embodiment of the process according to the invention is characterized in that the power consumption of the grinding spindle drive with and without coolant switched on is measured with the grinding tool at a first test position clear of the workpiece, and with the grinding tool at a second test position close to the workpiece surface, that the sets of measured results of the alteration in power consumption are each compared with specified desired value ranges, and that intervention is undertaken in the setting process of the grinding machine if the measured results lie outside the desired ranges.

Preferably the grinding tool is driven at a first specified speed of rotation in the first test position, and at a second specified speed different from the first specified speed in the second test position.

For the measurement in the first test position the grinding tool is preferably at a position in which the behaviour of the coolant stream directed onto the grinding tool is not influenced by the workpiece, work fixture or tailstock.

For the measurement in the second test position the grinding tool is preferably immediately close to the workpiece, the gap formed relative to the latter being of specified width.

A further embodiment of the invention is characterized in that the desired value range of the alteration in power consumption of the grinding spindle drive caused by the switch-on of coolant flow is fed into a machine control system, and that the grinding machine performs the test procedure in an automatic test cycle.

In order to avoid damage it is moreover of advantage if, in the event of a measured value deviating from the desired value range, the machining process of the grinding machine is blocked.

Another embodiment of the invention is characterized in that the coolant nozzle is automatically displaceable in at least one spacial direction, and/or is automatically swivellable about at least one axis, and that in the event of a measured value deviating from the desired range the setting of the coolant nozzle is altered by a machine control system in a subsequent corrective cycle by means of an automatic swivelling or displacement in at least one of the axes, such that the measured values are brought into the specified desired range without intervention of the setter or operator.

Preferably, after the setting of the machine, the alterations in the power consumption of the grinding spindle drive are measured in an automatic test cycle by switching on the coolant flow with the grinding wheel at a first test position clear of the workpiece, and with the grinding wheel at a second test position close to the workpiece surface, and the measured values compared with the specified desired value ranges in the machine control system, the machining process then being blocked if the measured values lie outside the desired value ranges.

For the first test measurement the grinding wheel is at a position where the behaviour of the coolant stream meeting the grinding wheel is not influenced by the workpiece, work fixture or tailstock. For the second test measurement on the other hand, the grinding wheel is in the immediate vicinity of the workpiece, forming with the latter a narrow lubricating gap of specified width, but where the grinding wheel and workpiece are not in contact.

BRIEF DESCRIPTION OF THE DRAWINGS

In the following the invention is explained in detail by way of a preferred embodiment, which is illustrated in the annexed drawings. The drawings depict.

DETAILED DESCRIPTION OF THE PREFERRED EMBODIMENT

Figure 1:
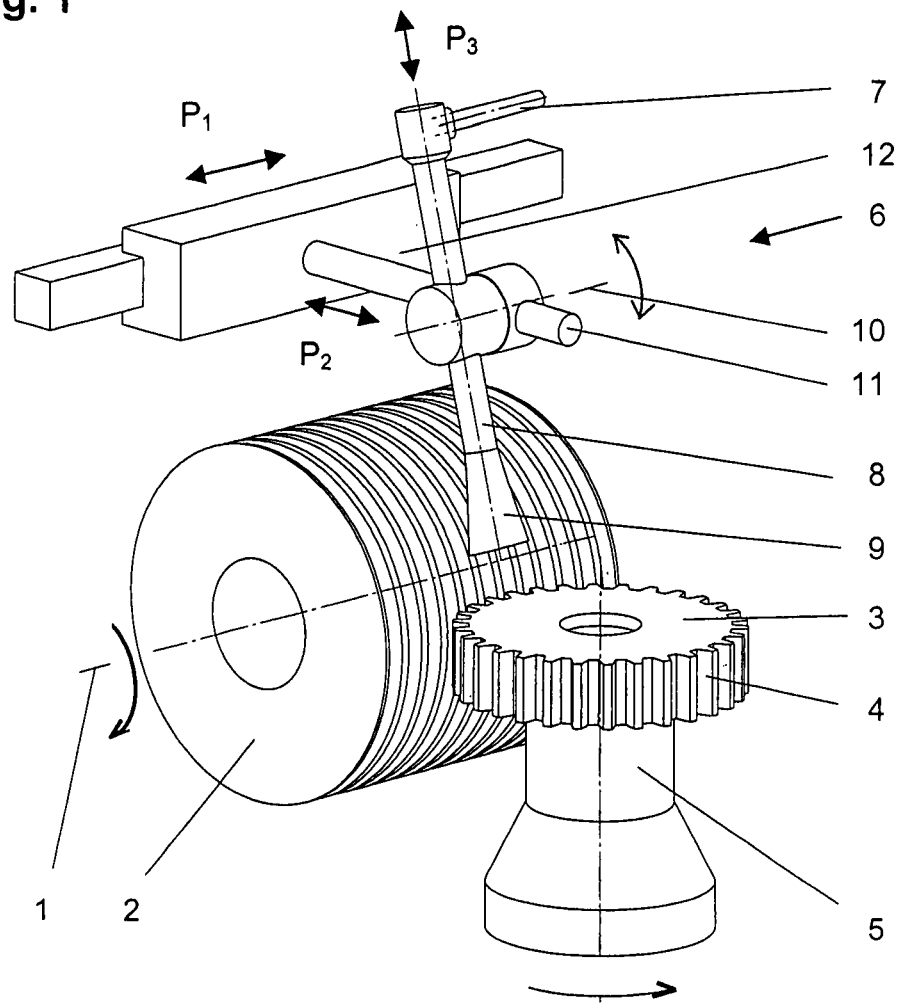
FIG. 1 A diagrammatic representation of the arrangement of a coolant nozzle on a machine for the continuous generative grinding of a gear with pre-machined teeth, FIG. 2 A diagrammatic representation of the liquid gap between a grinding worm and a gear, and FIG. 3 A control system diagram for a machine for implementing the process according to the invention.
Figure 2:
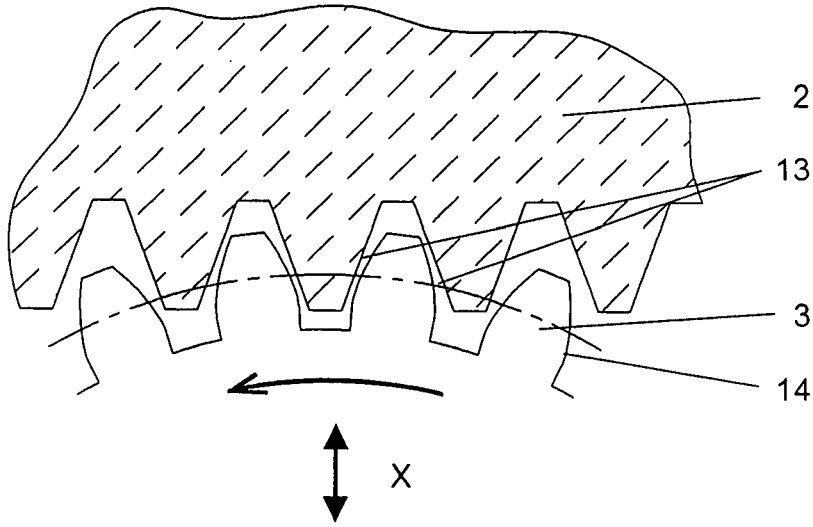

The invention is described in detail using the example of a grinding machine (24 in FIG. 3) for the continuous generative grinding of the flanks of gears with premachined teeth. FIG. 1 shows a grinding worm 2 located for rotation about a grinding spindle axis 1 in a grinding spindle (19 in FIG. 3) on the grinding machine 24, the said grinding worm 2 being driven by a grinding spindle drive (18 in FIG. 3) not shown in FIG. 1. The workpiece (gear) 3 with external teeth 4 is set up on a work fixture 5, which is connected to the machine for driven rotation and displaceable in the infeed direction X relative to the grinding worm 2.

The coolant supply 6 comprises a coolant hose 7, a supply tube 8 and a coolant nozzle 9 connected to the latter. The supply tube 8 is displaceable in its longitudinal direction (coolant nozzle infeed direction) P3, swivellable about a swivel axis 10, and displaceable in the longitudinal direction (supply tube displacement direction) P2 of a carrier arm 11, to which arm 11 it can be locked but detached. The carrier arm 11 is arranged on a slide 12 which is located on the machine for driven displacement parallel to the grinding spindle axis 1 in a slide displacement direction P1. The slide 12 serves to cause the coolant nozzle (grinding oil nozzle) 9 to automatically follow the point of engagement of the grinding worm 2, which during the course of machining shifts in the P1 direction as a natural result of the machining process.

The setting of the coolant nozzle 9 is correct when on the one hand the coolant jet emitted from the coolant nozzle 9 meets the cylinder of the grinding worm 2 tangentially at half thread height, and on the other hand during the grinding process the coolant jet is so directed to the gap 13 between the grinding worm 2 and gear 3 that the coolant/lubricant is drawn by the surface of the rotating grinding worm 2 into the gap 13 with its specified gap width.

Figure 3:
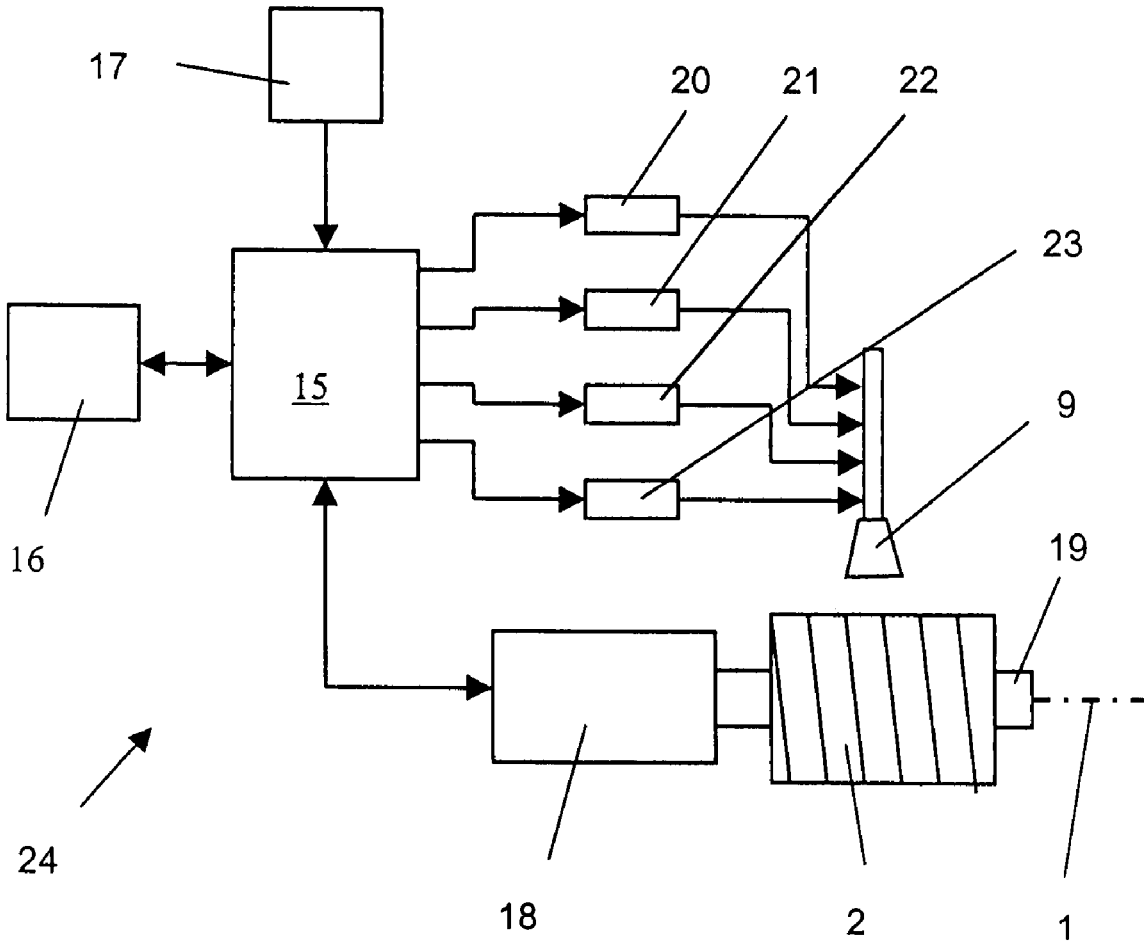

According to FIG. 3 the grinding machine 24 has a central machine control system 15, which is connected to a memory 16 for storing desired values and to an input unit 17 for the read-in of control commands and desired values. The machine control system 15 receives measured values (e.g. of the power consumption) from the grinding spindle drive 18. The machine control system 15 controls several adjusting devices 20, . . . , 23, which can displace the coolant nozzle 9 in the directions P1, P2, P3 indicated in FIG. 1, and about the swivel axis 10.

To check the correctness of the setting of coolant nozzle 9 after having set the machine 24, the setter or operator triggers a special automatic test cycle by which, with the grinding worm 2 at a first position clear of the workpiece and driven at a first specified speed, the coolant supply is switched on, the thus caused alteration in the power consumption of the grinding spindle drive 18 measured, and the measured result compared with a specified desired value range (from the memory 16) in the machine control system 15. If the result of the first measurement lies within the specified tolerance range, the grinding worm 2, driven at a second specified speed, is shifted to a second position close to the workpiece, where a gap 13 of specified width remains between the flanks of the grinding worm 2 and the tooth flanks 14 of the workpiece 3. After the measurement of the thus caused alteration in the power consumption of the grinding spindle drive 18 and the comparison of the measured value with the specified desired value also at this grinding worm position close to the workpiece, the automatic test cycle is finished.

If both measured values lie within the tolerance range, the control system releases the machining process. If on the other hand one measured value or both is/are above or below the tolerance range, the machining process is blocked, and the setting of coolant nozzle 9 must be re-examined by the setter or operator before he triggers a new test cycle.

In a further embodiment of the invention, in the event of a deviation of a measured value from the desired value range, a correction cycle following the test cycle alters the setting of the coolant nozzle 2 by automatically swivelling or displacement in a least one of the axes 10, P1, P2 and P3 by means of the adjusting devices 20, . . . ,23, such that both measured values come to lie in the specified desired value range without the intervention of the setter or operator.

LIST OF REFERENCE NUMBERS

1 Grinding spindle axis
2 Grinding tool (grinding worm)
3 Workpiece (gear)
4 External teeth
5 Work fixture
6 Coolant supply
7 Coolant hose
8 Supply tube
9 Coolant nozzle
10 Swivel axis
11 Carrier arm
12 Slide
13 Gap
14 Tooth flank
15 Machine control system
16 Memory 17 Input unit
18 Grinding spindle drive
19 Grinding spindle
20 Displacement device P1
21 Displacement device P2
22 Displacement device P3
23 Displacement device (swivel axis 10)
24 Grinding machine
X Infeed direction
P1 Slide displacement direction
P2 Supply tube displacement direction
P3 Coolant nozzle infeed direction

The invention claimed is:

1. A process for monitoring the correct setting a coolant nozzle of a grinding machine, wherein said grinding machine comprises a grinding spindle with a grinding tool driven by a grinding spindle drive; comprising the steps of:

setting the grinding machine;

thereafter measuring the power consumption of the grinding spindle drive with and without the coolant supply switched on;

comparing the measurements of the power consumption with and without the coolant supply switched on;

setting the coolant nozzle based on the comparing; and initiating the machine processing if a test criteria for machine processing is met.

2. The process according to claim 1, wherein the grinding machine is a machine for grinding the tooth flanks of workpieces with premachined teeth.

3. The process according to claim 1, wherein the grinding tool is a grinding worm.

4. The process according to claim 1, wherein in a measured value for the alteration in power consumption derived from the two measurements is compared with a specified desired value range, and wherein an intervention in the setting process of the grinding machine is prompted if the measured value lies outside the desired value range.

5. Process according to claim 4, wherein the coolant nozzle is automatically displaceable in at least one special direction and/or automatically swivellable about at least one swivel axis, and wherein, in the event of a deviation of a measured value from the desired value range, the setting of the coolant nozzle is altered by a machine control system in a subsequent correction cycle by way of swivelling or displacement in at least one of the axes, such that the measured values are brought within the specified desired value range without the intervention of the setter or operator.

6. The process according to claim 1, wherein the power consumption of the grinding spindle drive with and without the coolant supply switched on is measured with the grinding tool at a first test position clear of the workpiece, and with the grinding tool at a second test position close to the workpiece surface, wherein the measured values of the alteration in the power consumption are in each case compared with specified desired value ranges, and wherein intervention in the setting process of the grinding machine is prompted if the measured values lie outside the desired value ranges.

7. The process according to claim 6, wherein in the first test position the grinding tool is driven at a first specified speed, and in the second test position at a second specified speed differing from the first specified speed.

8. The process according to claim 6, wherein for the measurement in the first test position the grinding tool is at a position in which the behaviour of the coolant stream directed onto the grinding tool is not influenced by the workpiece, work fixture or tailstock.

9. The process according to claim 6, wherein for the measurement in the second position the grinding tool is in the immediate vicinity of the workpiece, forming with the latter a gap of specified width.

10. Process for monitoring the correct setting of a coolant nozzle of a grinding machine, which said grinding machine comprises a grinding spindle with a grinding tool driven by a grinding spindle drive, wherein after setting the grinding machine the power consumption of the grinding spindle drive is measured with and without the coolant supply switched on, and wherein by the comparison of the two measurements the settings of the coolant nozzle is assessed;

wherein in a measured value for the alteration in power consumption derived from the two measurements is compared with a specified desired value range, and wherein an intervention in the setting process of the grinding machine is prompted if the measured value lies outside the desired value range; and wherein the desired value ranges of the alteration in power consumption of the grinding spindle drive caused by the switch-on of the coolant supply are specified in a machine control system, and wherein the grinding machine performs the test process in an automatic test cycle.

11. The process according to claim 10, wherein the grinding machine is a machine for grinding the tooth flanks of workpieces with premachined teeth.

12. The process according to claim 10, wherein the grinding tool is a grinding worm.

13. The process according to claim 10, wherein the power consumption of the grinding spindle drive with and without the coolant supply switched on is measured with the grinding tool at a first test position clear of the workpiece, and with the grinding tool at a second test position close to the workpiece surface, wherein the measured values of the alteration in the power consumption are in each case compared with specified desired value ranges, and wherein intervention in the setting process of the grinding machine is prompted if the measured values lie outside the desired value ranges.

14. The process according to claim 13, wherein in the first test position the grinding tool is driven at a first specified speed, and in the second test position at a second specified speed differing from the first specified speed.

15. The process according to claim 13, wherein for the measurement in the first test position the grinding tool is at a position in which the behaviour of the coolant stream directed onto the grinding tool is not influenced by the workpiece, work fixture or tailstock.

16. The process according to claim 13, wherein for the measurement in the second position the grinding tool is in the immediate vicinity of the workpiece, forming with the latter a gap of specified width.

17. Process for monitoring the correct setting of a coolant nozzle of a grinding machine, which said grinding machine comprises a grinding spindle with a grinding tool driven by a grinding spindle drive, wherein after setting the grinding machine the power consumption of the grinding spindle drive is measured with and without the coolant supply switched on, and wherein by the comparison of the two measurements the settings of the coolant nozzle is assessed;

wherein in a measured value for the alteration in power consumption derived from the two measurements is compared with a specified desired value range, and wherein an intervention in the setting process of the grinding machine is prompted if the measured value lies outside the desired value range; and wherein in the event of a deviation of a measured value from the desired value range the machining process of the grinding machine is blocked.

18. The process according to claim 17, wherein the grinding machine is a machine for grinding the tooth flanks of workpieces with premachined teeth.

19. The process according to claim 17, wherein the grinding tool is a grinding worm.

20. The process according to claim 17, wherein the power consumption of the grinding spindle drive with and without the coolant supply switched on is measured with the grinding tool at a first test position clear of the workpiece, and with the grinding tool at a second test position close to the workpiece surface, wherein the measured values of the alteration in the power consumption are in each case compared with specified desired value ranges, and wherein intervention in the setting process of the grinding machine is prompted if the measured values lie outside the desired value ranges.

* * * * *